US006184834B1

(12) United States Patent
Utsumi et al.

(10) Patent No.: US 6,184,834 B1
(45) Date of Patent: Feb. 6, 2001

(54) ELECTRONIC PRICE LABEL ANTENNA FOR ELECTRONIC PRICE LABELS OF DIFFERENT SIZES

(75) Inventors: Yoshitaka Utsumi, Kanagawa (JP); Cuong Tran, Howell, NJ (US)

(73) Assignee: NCR Corporation, Dayton, OH (US)

( * ) Notice: Under 35 U.S.C. 154(b), the term of this patent shall be extended for 0 days.

(21) Appl. No.: 09/250,860

(22) Filed: Feb. 17, 1999

(51) Int. Cl.[7] ..... H01Q 1/24

(52) U.S. Cl. ..... 343/702; 343/700 MS; 343/846

(58) Field of Search ..... 343/700 MS, 846, 343/702, 848; H01Q 1/24

(56) References Cited

U.S. PATENT DOCUMENTS

| | | | | |
|---|---|---|---|---|
| 4,002,886 | | 1/1977 | Sundelin | 235/61.7 R |
| 4,500,880 | | 2/1985 | Gomersall et al. | 340/825.35 |
| 4,791,423 | * | 12/1988 | Yokoyama et al. | 343/700 MS |
| 4,924,363 | | 5/1990 | Kornelson | 362/125 |
| 5,172,314 | | 12/1992 | Poland et al. | 364/401 |
| 5,394,159 | | 2/1995 | Schneider et al. | 343/700 MS |
| 5,448,226 | | 9/1995 | Failing, Jr. et al. | 340/825.35 |
| 5,668,560 | | 9/1997 | Evans et al. | 343/702 |
| 6,026,373 | * | 2/2000 | Goodwin, III | 705/20 |
| 6,031,494 | * | 2/2000 | Okabe et al. | 343/702 |

* cited by examiner

*Primary Examiner*—Hoanganh Le
(74) *Attorney, Agent, or Firm*—Paul W. Martin

(57) ABSTRACT

An electronic price label which is suitable for use in both small EPLs having lengths of about 1.5 to 2 inches and large size EPLs having lengths of about 3 to 4 inches. The antenna includes a folded planar conductor including a generally planar radiator portion coupled to a antenna port on a printed circuit board, a generally planar ground plane portion coupled to a ground on the printed circuit board having a width and oriented generally parallel to the radiator portion, and a dielectric layer between the radiator portion and the ground plane portion. The width of the ground plane portion is larger than the width of the radiator portion by a distance sufficient to produce an electric field which is linearly polarized in the width direction, thereby eliminating a need for shielding.

10 Claims, 8 Drawing Sheets

ELECTRONIC PRICE LABEL ANTENNA FOR ELECTRONIC PRICE LABELS OF DIFFERENT SIZES

BACKGROUND OF THE INVENTION

The present invention relates to electronic price label (EPL) systems, and more specifically to an electronic price label antenna for electronic price labels of different sizes.

EPL systems typically include a plurality of EPLs for merchandise items in a transaction establishment. EPLs typically display the prices of corresponding merchandise items on store shelves and are typically attached to a rail along the leading edge of the shelves. A transaction establishment may contain thousands of EPLs to display the prices of the merchandise items. The EPLs are coupled to a central server from where information about the EPLs is typically maintained in an EPL data file. Price information displayed by the EPLs is obtained from a price look-up (PLU) data file and stored within an EPL price change record.

EPLs are produced in different sizes. Two sizes are typically mounted to shelf rails or edges. A first or large size EPL is typically about three to four inches in length and is used in connection with most items in a store. An example of the a large size EPL is disclosed in U.S. Pat. No. 5,668,560, which is assigned to the assignee of the present invention. This patent is hereby incorporated by reference.

A second or small size EPL has been created for use in connection with small items which occupy very little shelf space. Use of the small size EPL allows many different types of small items to placed adjacent one another. Use of a large size EPL in connection with these small items would waste shelf space between small items. The small size EPL is about one and a half inches to two inches in length and has a smaller display than the large size EPL. The small size EPL also takes a smaller adhesive overlay for displaying item information which rarely changes.

One problem with the small size EPL is that it includes a different antenna than the large size EPL, since the antenna in the large size EPL is too large.

Therefore, it would be desirable to provide a common antenna and communication circuitry design for large and small size EPLs in order to reduce overall cost.

SUMMARY OF THE INVENTION

In accordance with the teachings of the present invention, an electronic price label (EPL) antenna for electronic price labels of different sizes is provided.

The electronic price label is suitable for use in both small EPLs having lengths of about 1.5 to 2 inches and large size EPLs having lengths of about 3 to 4 inches.

The antenna includes a folded planar conductor including a generally planar radiator portion coupled to a antenna port on a printed circuit board, a generally planar ground plane portion coupled to a ground on the printed circuit board having a width and oriented generally parallel to the radiator portion, and a dielectric layer between the radiator portion and the ground plane portion. The width of the ground plane portion is larger than the width of the radiator portion by a distance sufficient to produce an electric field which is linearly polarized in the width direction, thereby eliminating a need for shielding.

It is accordingly an object of the present invention to provide an EPL antenna for EPLs of different sizes.

It is another object of the present invention to provide an improved EPL antenna design.

It is another object of the present invention to provide an EPL antenna which requires fewer solder points.

It is another object of the present invention to provide an EPL antenna which is small enough in height to reduce EPL housing sizes to no more than about 7 mm to 9 mm.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION OF THE PREFERRED EMBODIMENT

Figure 1:
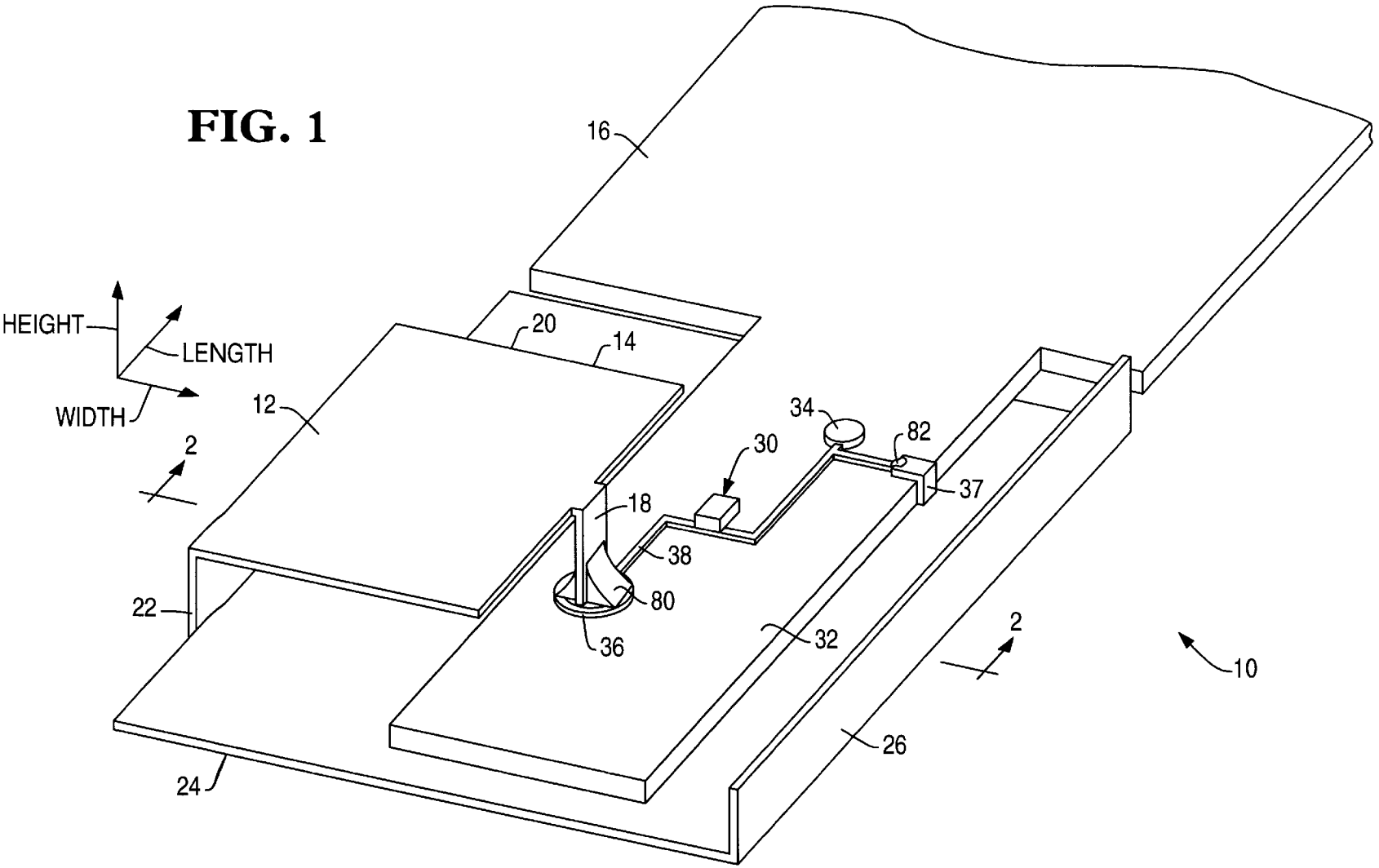
FIG. 1 is a perspective view of the EPL antenna and a circuit board with communication circuitry.
Figure 2:
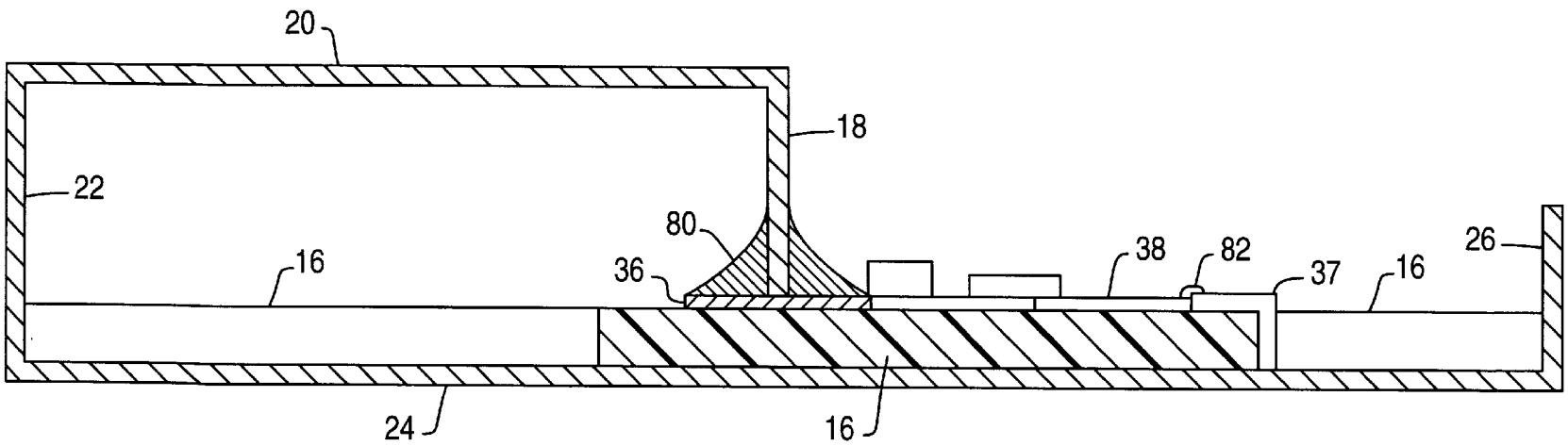
FIG. 2 is a cross sectional view of the EPL antenna and circuit board of FIG. 1 through plane 1—1.

Referring to FIGS. 1 and 2, antenna 12 and printed circuit board 16 of electronic price label 10 are shown.

Antenna 12 is an air dielectric quarter-wave antenna, implemented as a folded planar conductor 14. Antenna 12 may also be referred to as a microstrip patch antenna. Antenna 12 includes strip 18, top planar conductor 20, first side planar conductor 22, bottom planar conductor 24, and second side planar conductor 26.

Strip 18 is generally centered along top planar conductor 20 and is oriented substantially perpendicularly to top planar conductor 20. Strip 18 and contacts printed circuit board 16. Strip 18 maintains antenna 12 at a predetermined height above bottom planar conductor 24. The bottom end of strip 18 forms an antenna port 36 for passing a received signal to communication circuitry 30. Strip 18 is about 3 mm in height. Printed circuit board 16 has a thickness of about 1 mm. Communication circuitry 30 is shown as a single element to simplify the drawings, but actually employs much of the area of printed circuit board 16.

Top planar conductor 20 acts as a radiator of antenna 12. Top planar conductor 20 is about 20 mm long by about 15 mm wide. Top planar conductor 20 is oriented substantially perpendicularly to first side planar conductor 22.

First side planar conductor 22 is electrically connected or shorted to bottom planar conductor 24 and is oriented substantially perpendicularly and centered along bottom planar conductor 24. First side planar conductor 22 maintains antenna 12 at a predetermined height above bottom planar conductor 24. First side planar conductor 22 is about 20 mm long by about 4 mm high.

Bottom planar conductor 24 acts as a ground plane of antenna 12 and is electrically connected to the common ground of communication circuitry 30 through electrical trace 37 on printed circuit board 16. Bottom planar conductor 24 is substantially parallel to top planar conductor 20. Bottom planar conductor 24 is about 27 mm long by about 30 mm wide.

Second side planar conductor 26 extends bottom planar conductor 24 and also acts as corner reflector which enhances the performance of antenna 12. This additional ground plane area provides better antenna performance. Second side planar conductor 26 is about 27 mm long by about 5 mm high.

Antenna 12 has an operating frequency of about 2.45 GHz. Antenna 12 uses the air gap between top planar conductor 20 and bottom planar conductor 24 as a dielectric. The width of top planar conductor 20 (about 15 mm) together with the height of first side planar conductor 22 (about 4 mm) determine the resonant frequency of antenna 12. The length of top planar conductor 20 (about 20 mm), the length of first side planar conductor 22 (about 20 mm) and the length and height of strip 18 (about 1 mm and 3 mm, respectively) determine the impedance of antenna port 36.

Advantageously, bandwidth is optimal. The length of top planar conductor 20 (about 20 mm) is as large as possible given the EPL size limitation and the balancing of resonance frequency and impedance. Also, the height of top planar conductor member 20 from bottom planar conductor 24 is increased to a maximum height given EPL size limitations. The difference between ground plane area provided by bottom planar conductor 24 and second side planar conductor 26 (about 27×35 mm) and radiator area provided by top planar conductor 20 (about 20×15 mm) makes antenna 12 relatively directive and gives antenna 12 a good antenna gain and high efficiency.

Antenna 12 is linearly polarized. The distance between top planar conductor 20 and second side planar conductor 26 results in an electric field which radiates mainly in the width axis (FIG. 1). Therefore, the close proximity of displays 42 or 52 along the length axis (to the left or right of antenna 12) has very little affect on performance.

Planar conductor 14 may be fabricated from a stainless or cold-rolled steel to a thickness of about 0.2 mm. Planar conductor 14 is then bent, resulting in antenna 12 having the shape illustrated in FIG. 1.

Printed circuit board 16 sits on antenna 12. Since bottom planar conductor 24 acts as the ground plane, printed circuit board 16 area is minimized.

Printed circuit board 16 includes communication circuitry 30 and power supply 34.

Communication circuitry 30 is preferably wireless communication circuitry which operates using wireless backscatter communication techniques.

Power supply 34 is preferably a battery.

Strip 18 connects to communication circuitry 30 through electrical traces 38 to form an antenna port 36 for antenna 12. With reference to FIG. 2, antenna port 36 is a soldering pad on printed circuit board 16 and connects to electrical traces 38. Advantageously, printed circuit board 16 includes only two solder points 80 and 82, point 80 at antenna port 36 and point 82 at common ground electrical trace 37.

A signal incident on antenna 12 generates an RF voltage between antenna port 36 and bottom planar conductor 24. This RF voltage is resonated and detected by detector 60 (FIG. 7) in communication circuitry 30. Antenna 12 is designed to have a port impedance that is inductive to conjugately match the capacitive impedance of detector 60.

Figure 3:
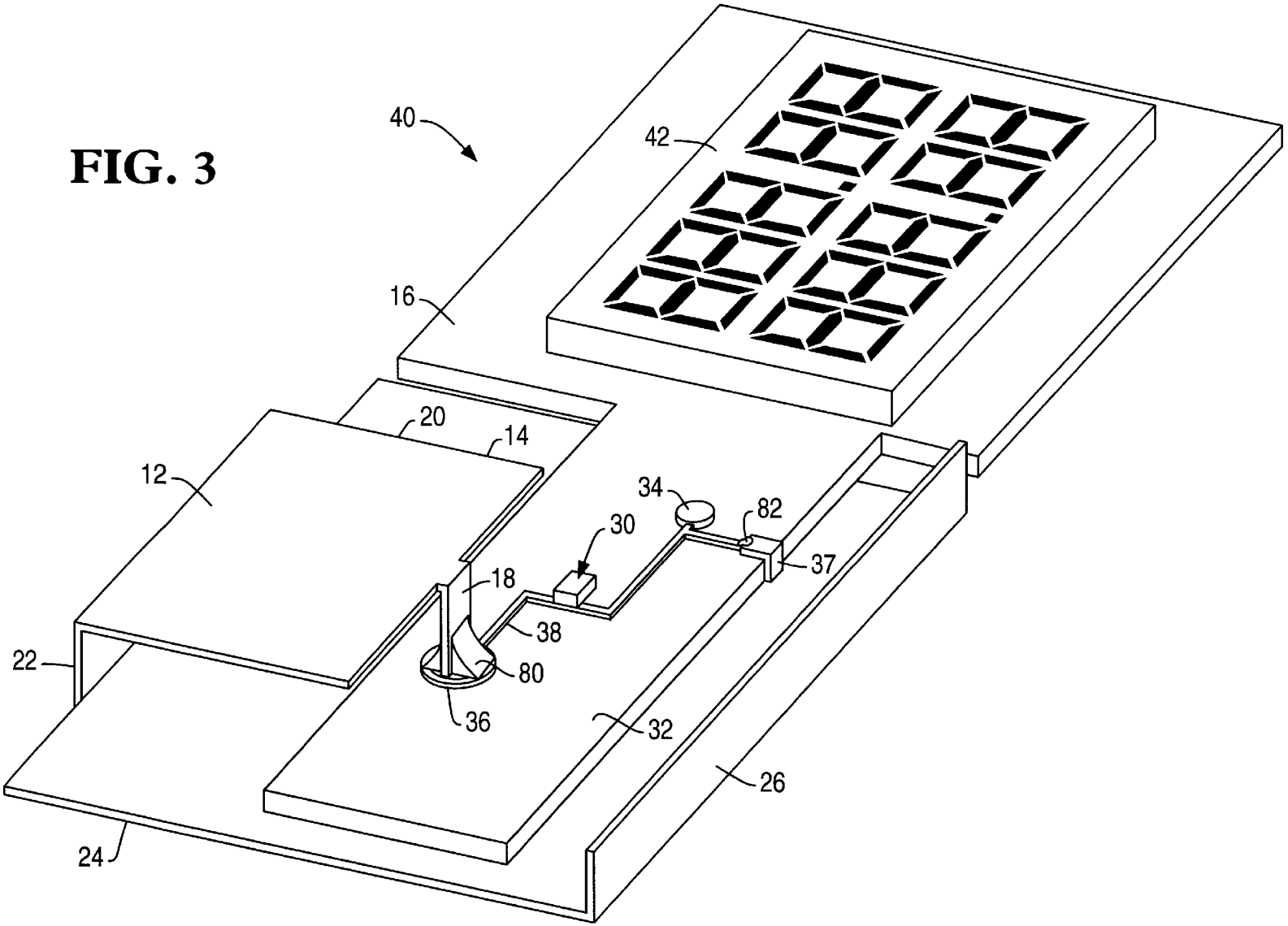
FIG. 3 is a perspective view of the EPL antenna, the circuit board, and a small size display.

Turning now to FIG. 3, antenna 12, printed circuit board 16, and small size display 42 of small size electronic price label 40 are shown.

Small size display 42 is typically capable of displaying 2×4 or 2×5 characters and is about 30 mm(length)×25 mm(width)×2.5 mm(height). Small size display 42 is mounted on top of printed circuit board 16 in a compact fashion. Given that display 42 is located along the length axis, antenna performance was optimized along the width axis instead. Thus, the presence of display 42 has a minimal affect on antenna performance along the length axis and no shielding is required.

Figure 4:
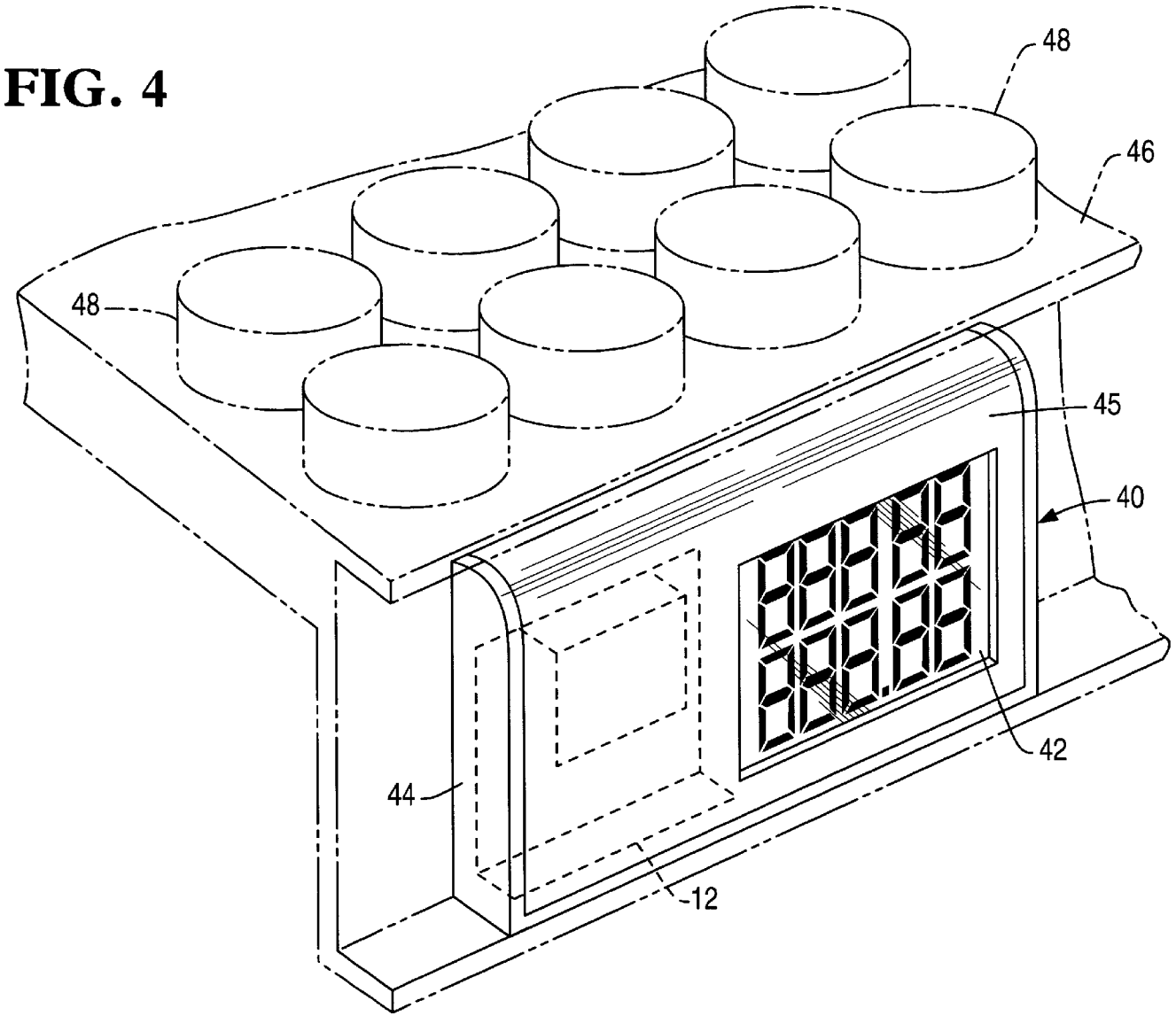
FIG. 4 is a perspective view of a small size EPL containing the components of FIG. 3.

Turning now to FIG. 4, small size electronic price label 40 is shown.

Small size electronic price label 40 further includes housing 44 and overlay 45. Housing 44 can be made smaller in height, to no more than about 7 mm to 9 mm, using antenna 12. Housing 44 fits within a suitable mount on the edge of shelf 46 where small items are arranged.

Overlay 45 typically uses as much frontal surface area of housing 44 as is practical for displaying static information.

Figure 5:
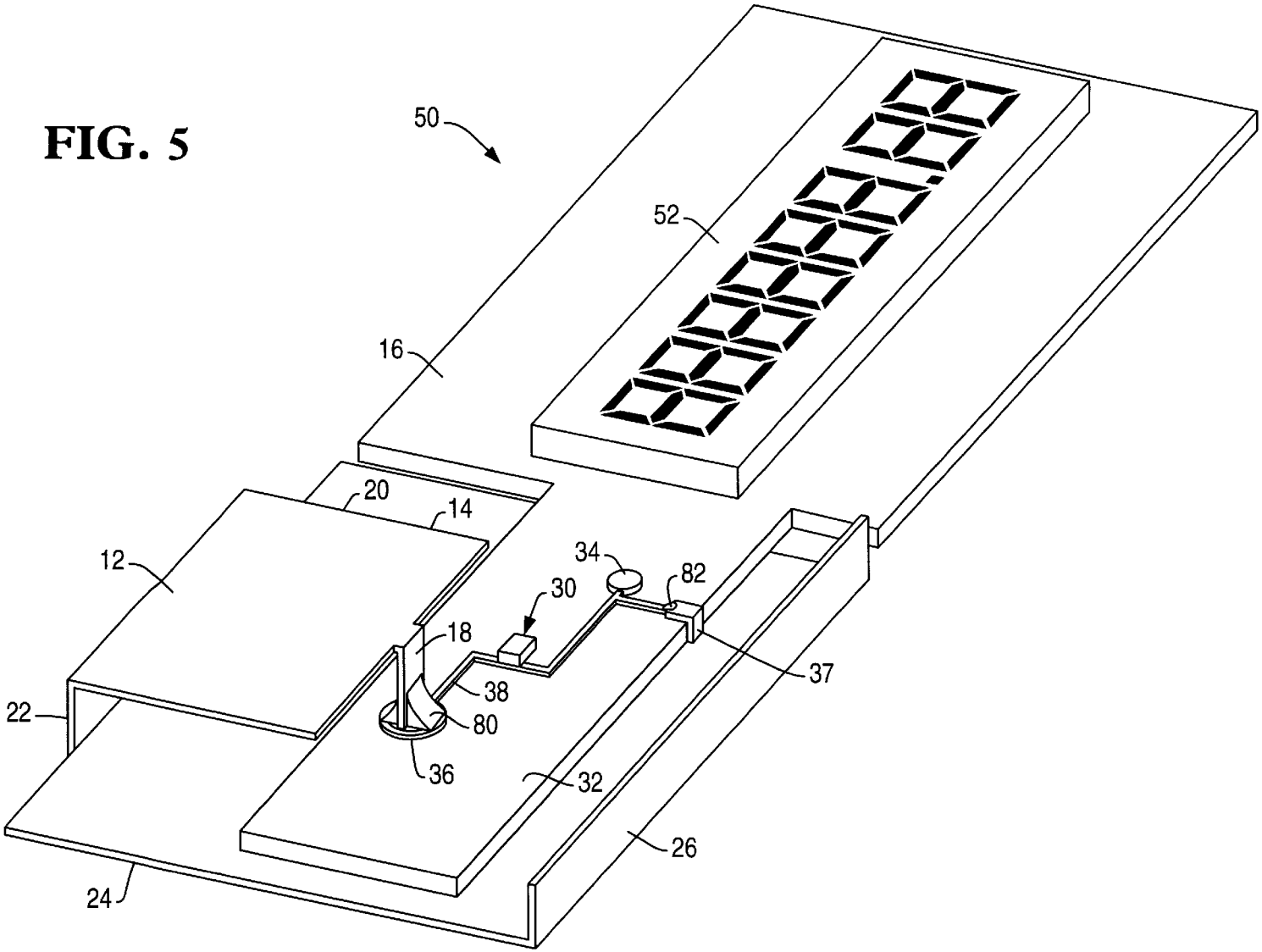
FIG. 5 is a perspective view of the EPL antenna, the circuit board, and a large size display.

Turning now to FIG. 5, antenna 12, printed circuit board 16, and large size display 52 of large size electronic price label 50 are shown.

Large size display 52 is typically capable of displaying typically, 2×4 or 2×6 characters. Large size display 52 is about 70 mm(length)×20 mm(width)×2.5 mm(height) in size and is mounted on top of printed circuit board 16. Given that display 42 is located along the length axis, antenna performance was optimized along the width axis instead. Thus, the presence of display 42 has a minimal affect on antenna performance along the length axis and no shielding is required.

Figure 6:
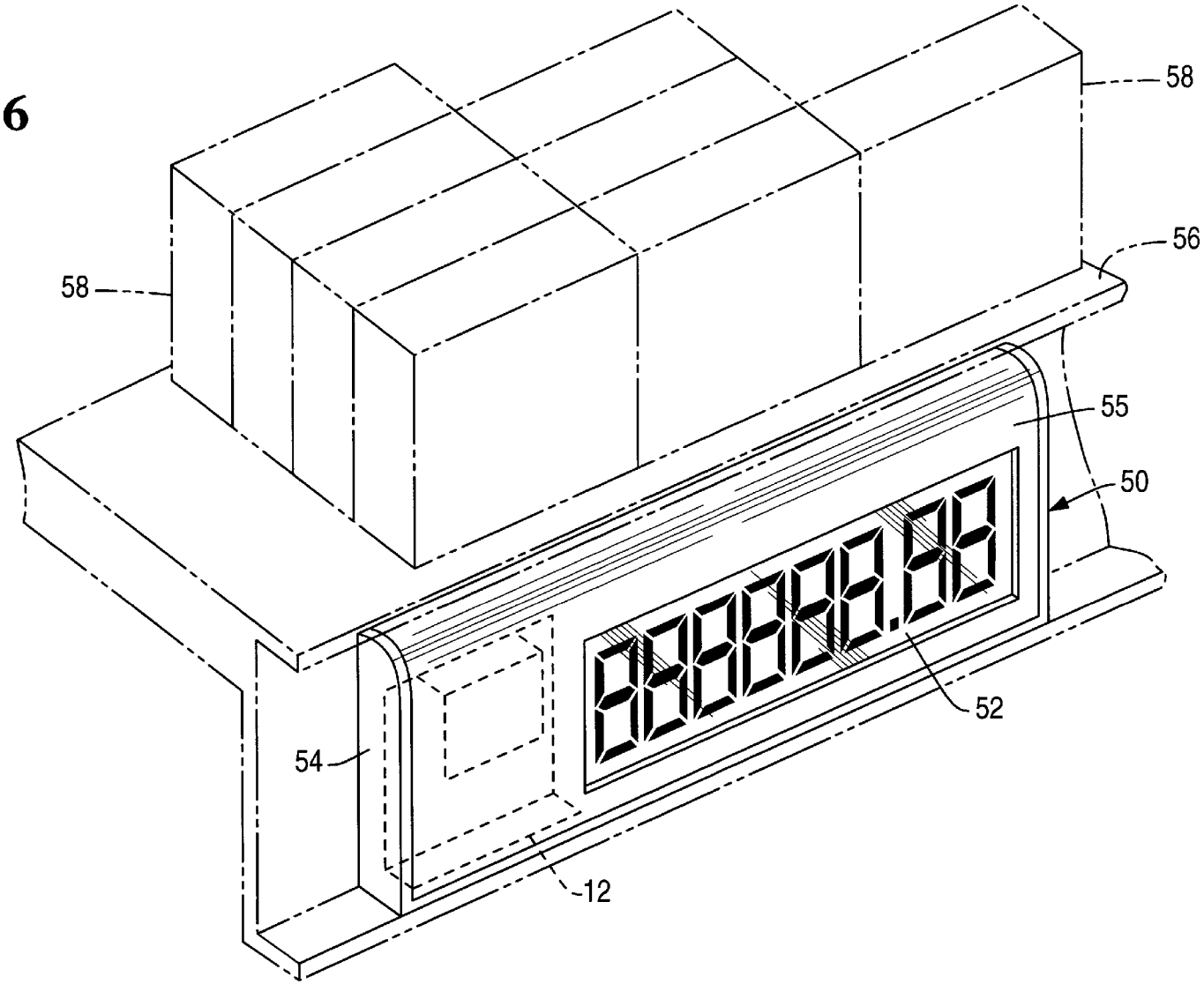
FIG. 6 is a perspective view of a large size EPL containing the components of FIG. 5.

Turning now to FIG. 6, large size electronic price label 50 is shown.

Large size electronic price label 50 further includes housing 54 and overlay 55. Housing 54 can be made smaller in height, to no more than about 7 mm to 9 mm, using antenna 12. Housing 54 fits within a suitable mount on the edge of shelf 56 where items 58 larger than small items 48 are arranged.

Overlay 55 typically uses as much frontal surface area of housing 54 as is practical for displaying static information. Thus, overlay 55 is larger than overlay 45.

Figure 7:
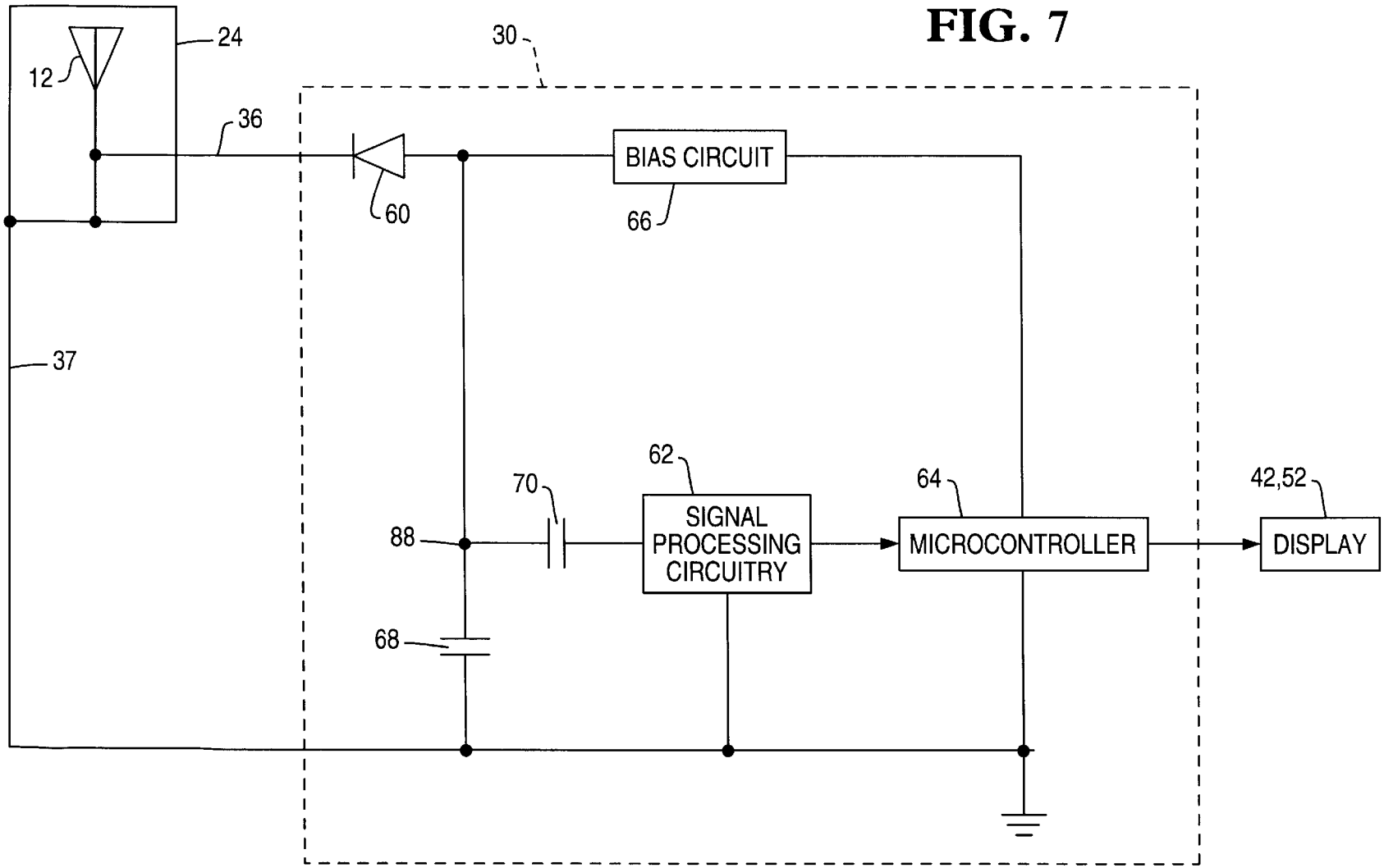
FIG. 7 is a block diagram of the large and small size EPLs.

Referring now to FIG. 7, communication circuitry 30 includes detector 60, signal processing circuitry 62, microcontroller 64, and bias control circuit 66.

Detector 60 is preferably a Schottky barrier-type silicon diode. Detector 60 couples to data port 88 at the junction of capacitance 68 and capacitance 70.

Figure 8:
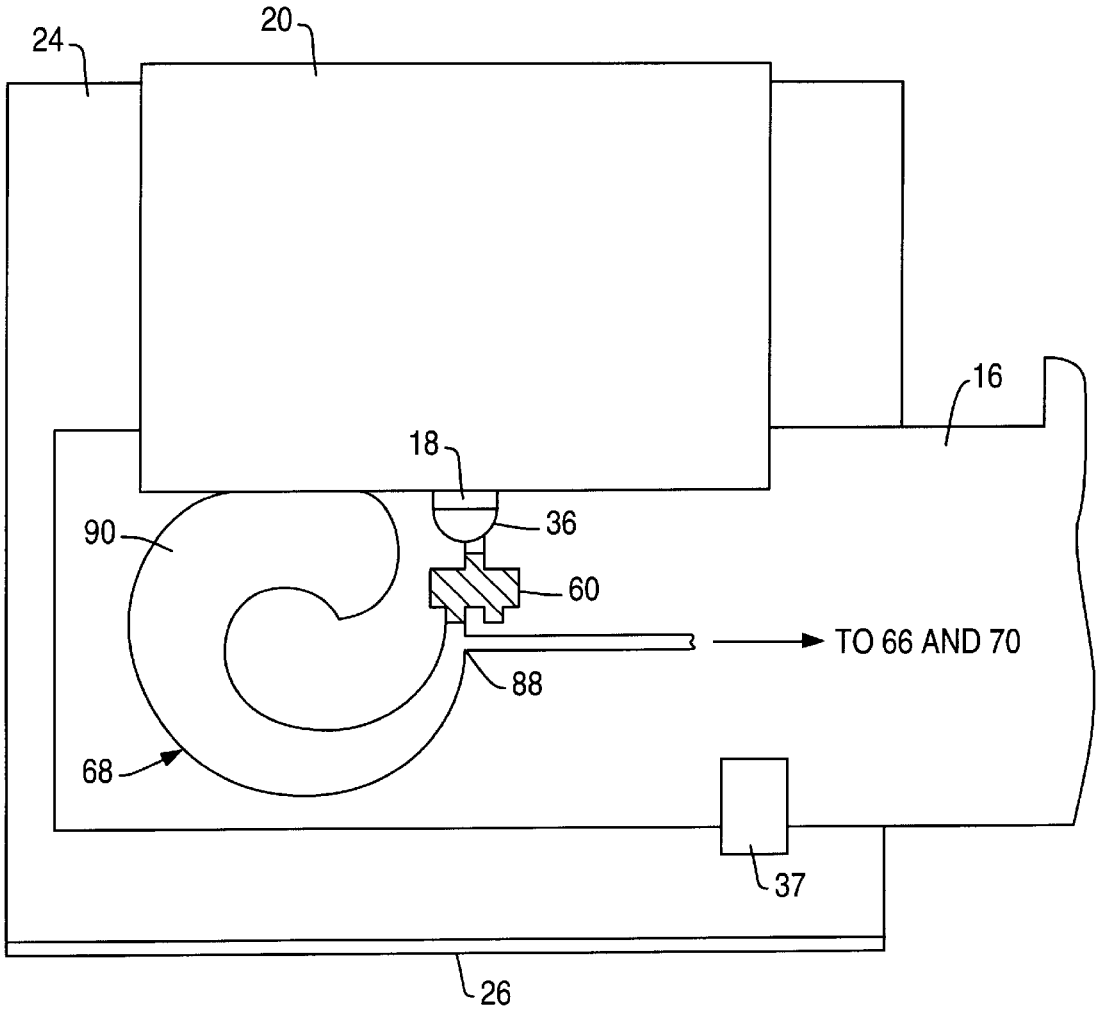
FIG. 8 is a diagram illustrating a capacitance used in the block diagram of FIG. 7.

Capacitance 68 is a quarter-wave transmission line or RF open-circuit stub, implemented as a curved trace 90 on printed circuit board 16 (FIG. 8). The load impedance at the open end of trace 90 is effectively an open circuit which is transformed to an RF short circuit at data port 88 during operation at the carrier frequency of 2.45 GHz.

Capacitance 70 is a discrete component between detector 60 and signal processing circuitry 62.

Operation is similar to the EPL disclosed in the previously incorporated U.S. Pat. No. 5,668,560. A modulated RF signal is received by antenna 12. Because of the series resonance of antenna 12 and diode 60, all of the detected RF signal appears across capacitance 68. Capacitance 70 couples the resulting signal to signal processing circuitry 62. Signal processing circuitry 62 amplifies the detected RF signal and detects on/off keyed data bits in the amplified RF signal. Microcontroller 64 processes the data bits to generate data for display by display 42 or 52. Microcontroller 64 also controls bias circuit 66 which controls a bias current and impedance of detector 60.

Advantageously, antenna 12 reduces cost because it can be used in different sizes of EPLs. It also allows housing heights to be reduced.

Although the present invention has been described with particular reference to certain preferred embodiments thereof, variations and modifications of the present invention can be effected within the spirit and scope of the following claims.

What is claimed is:

1. An electronic price label (EPL) antenna comprising:

a folded planar conductor including a first generally planar conductor which has first and second edges and a width and which acts as a radiator;

a second generally planar conductor which has first and second edges and a width, which is oriented generally parallel to the first generally planar conductor, and which acts as a ground;

a third generally planar conductor coupled substantially perpendicularly to the first edge of the second planar conductor at a first fold;

a fourth generally planar conductor coupled substantially perpendicularly between the second edge of the first generally planar conductor at a second fold and the second edge of the second generally planar conductor at a third fold; and a dielectric layer between the first and second generally planar conductors;

wherein the width of the second generally planar conductor is larger than the width of the first generally planar conductor by a distance sufficient to produce an electric field which is linearly polarized in the width direction;

wherein the first generally planar conductor has an area and the second generally planar conductor has an area, and wherein the area of the first generally planar conductor is less than the area of the second generally planar conductor; and wherein the folded planar conductor is small enough in area to fit within a small size EPL.

2. The antenna as recited in claim 1, further comprising:

a fifth generally planar conductor coupled at a fourth fold for linking the first edge of the first generally planar conductor to a printed circuit board accommodate placement of the printed circuit board between the first and second generally planar conductors.

3. The antenna as recited in claim 2, wherein the first, second, third, fourth and fifth generally planar conductors are substantially rectangular in shape.

4. The antenna as recited in claim 1, wherein the dielectric layer comprises air.

5. The antenna as recited in claim 1, wherein the fourth planar conductor has a height, and wherein the width of the first planar conductor and the height of the fourth planar conductor determine a resonant frequency.

6. The antenna as recited in claim 5, wherein the resonant frequency is a number of GHz.

7. The antenna as recited in claim 1, wherein the first planar conductor has a length, the fourth planar conductor has a length, and the fifth planar conductor has a length and height, wherein the length of the first planar conductor, the length of the fourth planar conductor, and the length and height of the fifth planar conductor determine an impedance at the antenna port.

8. A small size electronic price label (EPL) comprising:

a housing having a length no larger than about two inches;

a printed circuit board within the housing;

a liquid crystal display coupled to the printed circuit board; and a folded planar conductor antenna within the housing adjacent the liquid crystal display including a first generally planar conductor which has first and second edges and a width and which acts as a radiator;

a second generally planar conductor having first and second edges and a width and oriented generally parallel to the first generally planar conductor and which acts as a ground;

a third generally planar conductor coupled substantially perpendicularly to the first edge of the second planar conductor at a first fold;

a fourth generally planar conductor coupled substantially perpendicularly between the second edge of the first generally planar conductor at a second fold and the second edge of the second generally planar conductor at a third fold;

a fifth generally planar conductor coupled at a fourth fold for linking the first edge of the first generally planar conductor to a port on the printed circuit board;

wherein the printed circuitry board is disposed between the first and second generally planar conductors; and a dielectric layer between the first and second generally planar conductors;

wherein the width of the second generally planar conductor is larger than the width of the first generally planar conductor by a distance sufficient to produce an electric field which is linearly polarized in the width direction; and wherein the first generally planar conductor has an area and the second generally planar conductor has an area, and wherein the area of the first generally planar conductor is less than the area of the second generally planar conductor.

9. An electronic price label (EPL) antenna comprising:

a folded planar conductor which occupies an area small enough to fit within two different housings of two different sized EPLs including a first housing of a first EPL having a length no larger than about two inches and a second housing of a second EPL having a length larger than about two inches;

wherein the folded planar conductor includes a first generally planar conductor which has first and second edges and a width and which acts as a radiator;

a second generally planar conductor having first and second edges and a width and oriented generally parallel to the first generally planar conductor and which acts as a ground;

a third generally planar conductor coupled substantially perpendicularly to the first edge of the second planar conductor at a first fold;

a fourth generally planar conductor coupled substantially perpendicularly between the second edge of the first generally planar conductor at a second fold and the second edge of the second generally planar conductor at a third fold;

a fifth generally planar conductor coupled at a fourth fold for linking the first edge of the first generally planar conductor to a printed circuit board accommodate placement of the printed circuit board between the first and second generally planar conductors; and a dielectric layer between the first and second generally planar conductors;

wherein the width of the second generally planar conductor is larger than the width of the first generally planar conductor by a distance sufficient to produce an electric field which is linearly polarized in the width direction; and wherein the first generally planar conductor has an area and the second generally planar conductor has an area, and wherein the area of the first generally planar conductor is less than the area of the second generally planar conductor.

10. The antenna as recited in claim 9, wherein the folded planar conductor has a height of no more than about seven to nine millimeters.

* * * * *